US006652077B2

(12) United States Patent
Maeng et al.

(10) Patent No.: US 6,652,077 B2
(45) Date of Patent: Nov. 25, 2003

(54) HIGH-DENSITY INK-JET PRINTHEAD HAVING A MULTI-ARRAYED STRUCTURE

(75) Inventors: Doo-jin Maeng, Seoul (KR); Yong-soo Oh, Seongnam (KR); Sang-hoon Lee, Gunpo (KR); Keon Kuk, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/274,049

(22) Filed: Oct. 21, 2002

(65) Prior Publication Data

US 2003/0081078 A1 May 1, 2003

(30) Foreign Application Priority Data

Oct. 29, 2001 (KR) ..... 2001-0066747

(51) Int. Cl.[7] ..... B41J 2/05; B41J 2/14; B41J 2/16

(52) U.S. Cl. ..... 347/56; 347/47; 347/65

(58) Field of Search ..... 347/56, 61, 54, 347/44, 47, 63, 65, 67, 92, 94, 64

(56) References Cited

U.S. PATENT DOCUMENTS

| | | | | |
|---|---|---|---|---|
| 4,339,762 A | | 7/1982 | Shirato et al. | 347/62 |
| 4,847,630 A | | 7/1989 | Bhaskar et al. | 347/63 |
| 4,882,595 A | | 11/1989 | Trueba et al. | 347/92 |
| 4,990,939 A | * | 2/1991 | Sekiya et al. | 347/64 |
| 5,635,966 A | | 6/1997 | Keefe et al. | 347/43 |
| 5,760,804 A | | 6/1998 | Heinzl et al. | 347/56 |
| 5,841,452 A | * | 11/1998 | Silverbrook | 347/47 |
| 5,850,241 A | | 12/1998 | Silverbrook | 347/54 |

FOREIGN PATENT DOCUMENTS

| | | | |
|---|---|---|---|
| EP | 0317171 | 5/1989 | B41J/3/04 |

OTHER PUBLICATIONS

Tseng, et al.; A Novel Microinjector With Virtual Chamber Neck, 1998, pp. 57–62.

* cited by examiner

*Primary Examiner*—Juanita Stephens
(74) *Attorney, Agent, or Firm*—Lee & Sterba, P.C.

(57) ABSTRACT

A high-density ink-jet printhead, in which a plurality of nozzles, through which ink is ejected, are arrayed on an ink supply manifold in a plurality of rows is provided, wherein the ink-jet printhead includes a substrate; hemispherical ink chambers at a surface of the substrate; a manifold for supplying ink to the ink chambers; ink channels to be in flow communication with the ink chambers and the manifold; a nozzle plate monolithically formed with the substrate; nozzles formed on the nozzle plate, each formed to correspond to a center of each of the ink chambers; heaters formed on the nozzle plate, each having a ring shape and encircling a corresponding nozzle; and electrodes, positioned on the nozzle plate and electrically connected to the heaters, for applying current to the heaters, wherein the nozzles are arrayed on the manifold in at least in three rows, and preferably in five rows.

10 Claims, 6 Drawing Sheets

HIGH-DENSITY INK-JET PRINTHEAD HAVING A MULTI-ARRAYED STRUCTURE

BACKGROUND OF THE INVENTION

1. Field of the Invention

The present invention relates to a bubble jet type ink-jet printhead. More particularly, the present invention relates to a high-density ink-jet printhead in which a plurality of nozzles, through which ink is ejected, are arrayed on an ink supply manifold in a plurality of rows, thereby increasing the number of nozzles per unit area.

2. Description of the Related Art

In general, ink-jet printheads are apparatuses that eject a fine droplet of printer ink on a desired position of a paper to print an image containing one or more predetermined colors. To eject ink onto the paper, an ink-jet printer generally adopts an electro-thermal transducer method that ejects ink onto the paper by generating a bubble in ink using a heat source (this method is called a bubble jet type), or an electromechanical transducer method that ejects ink onto the paper using a change in the volume of ink due to the deformation of a piezoelectric body.

In a bubble-jet type ink ejection mechanism, as mentioned above, when power is applied to a heater including a resistance heating element, ink adjacent to the heater is rapidly heated to about 300° C. Heating the ink generates bubbles, which grow and swell, and thus apply pressure in the ink chamber filled with the ink. As a result, ink adjacent to a nozzle is ejected from the ink chamber through the nozzle.

There are multiple factors and parameters to consider in making an ink-jet printhead having an ink ejecting unit in a bubble-jet mode. First, it should be simple to manufacture, have a low manufacturing cost, and be capable of being mass-produced. Second, in order to produce high quality color images, the formation of undesirable satellite ink droplets that usually accompany an ejected main ink droplet must be avoided during the printing process. Third, cross-talk between adjacent nozzles, from which ink is not ejected, must be avoided, when ink is ejected from one nozzle, or when an ink chamber is refilled with ink after ink is ejected. For this purpose, ink back flow, i.e., when ink flows in a direction opposite to the direction in which ink is ejected, should be prevented. Fourth, for high-speed printing, the refilling period after ink is ejected should be as short a period of time as possible to increase the printing speed. That is, the driving frequency of the printhead should be high.

The above requirements, however, tend to conflict with one another. Furthermore, the performance of an ink-jet printhead is closely related to and affected by the structure and design, e.g., the relative sizes of ink chamber, ink passage, and heater, etc., as well as by the formation and expansion shape of the bubbles.

FIG. 1A illustrates an exploded perspective view of a structure of an ink ejector of a conventional bubble jet type ink-jet printhead according to the prior art. FIG. 1B illustrates a cross-sectional view for explaining a process of ejecting an ink droplet from a conventional bubble jet type ink-jet printhead. FIG. 1C illustrates a plan view of the arrangement of a plurality of nozzles in the conventional inkjet printhead of FIG. 1A.

A conventional bubble jet type ink-jet printhead shown in FIGS. 1A through 1C includes a substrate 10, barrier walls 38 that are formed on the substrate 10 and that form ink chambers 26, which are filled with ink 49, heaters 12 formed in the ink chambers 26, and a nozzle plate 18 having nozzles 16 from which an ink droplet 49' is ejected. The ink 49 is supplied to the ink chambers 26 via ink channels 24 from ink supply manifolds 14 in flow communication with an ink storage unit (not shown). As a result, the nozzles 16, which are in flow communication with the ink chambers 26, are also filled with the ink 49 due to capillary action. In the above ink-jet printhead, a plurality of heaters 12 and a plurality of ink chambers 26 are formed to correspond to the plurality of nozzles 16, and are arranged in a row, adjacent to each of the ink supply manifolds 14.

In operation of the above ink-jet printhead, the heaters 12 are supplied with current and heated to form bubbles 48 in the ink 49 filled in the ink chambers 26. Then, the bubbles 48 expand and put pressure on the ink 49 filled in the ink chambers 26, thereby ejecting an ink droplet 49' to the outside via the nozzles 16. Then, the ink 49 flows through the ink channels 24 to fill the ink chambers 26.

A process of manufacturing a conventional printhead having the above structure, however, is complicated because the nozzle plate 18 and the substrate 10 are individually made and then bonded together. In particular, the nozzle plate 18 may be misaligned with respect to the substrate 10 during manufacture.

Additionally, as previously mentioned, the plurality of nozzles 16, heaters 12 and ink chambers 26 are arranged on each manifold 14 in a row, but may be arranged at both sides of each manifold 14 in a row. With such a structure, however, there is a limitation in increasing the number of nozzles per unit area, i.e., the density of a nozzle. Accordingly, it is difficult to realize a high-density ink-jet printhead that prints quickly and has high resolution.

SUMMARY OF THE INVENTION

In an effort to solve the above problems, it is a feature of an embodiment of the present invention to provide a high-density ink-jet printhead in which hemispherical ink chambers are formed that satisfy the above conditions, and a plurality of nozzles are arranged on each ink supply manifold in a plurality of rows, thereby increasing the density of nozzles.

To provide the above feature, there is provided an ink-jet printhead including a substrate; a plurality of ink chambers formed in a hemispherical shape at a surface of the substrate and filled with ink; a manifold formed at a rear surface of the substrate, the manifold for supplying ink to the plurality of ink chambers; a plurality of ink channels each formed at a bottom of each of the plurality of ink chambers to be in flow communication with the manifold; a nozzle plate monolithically formed with the substrate; a plurality of nozzles formed on the nozzle plate, each formed to correspond to a center of each of the plurality of ink chambers; a plurality of heaters formed on the nozzle plate, each of the plurality of heaters having a ring shape and encircling a corresponding one of the plurality of nozzles; and a plurality of electrodes positioned on the nozzle plate and electrically connected to the plurality of heaters, the plurality of electrodes applying current to the heaters.

In an embodiment of the present invention, the plurality of nozzles are arrayed on the manifold in at least three rows. In a preferred embodiment of the present invention, the plurality of nozzles are arrayed on the manifold in five rows.

Preferably, the substrate is a silicon wafer and the nozzle plate is a silicon oxide layer formed by oxidizing a surface of the silicon wafer.

Preferably, each of the plurality of nozzles may have a nozzle guide extending in the depth direction of the ink chamber, at each edge of the plurality of nozzles.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Figure 1A:
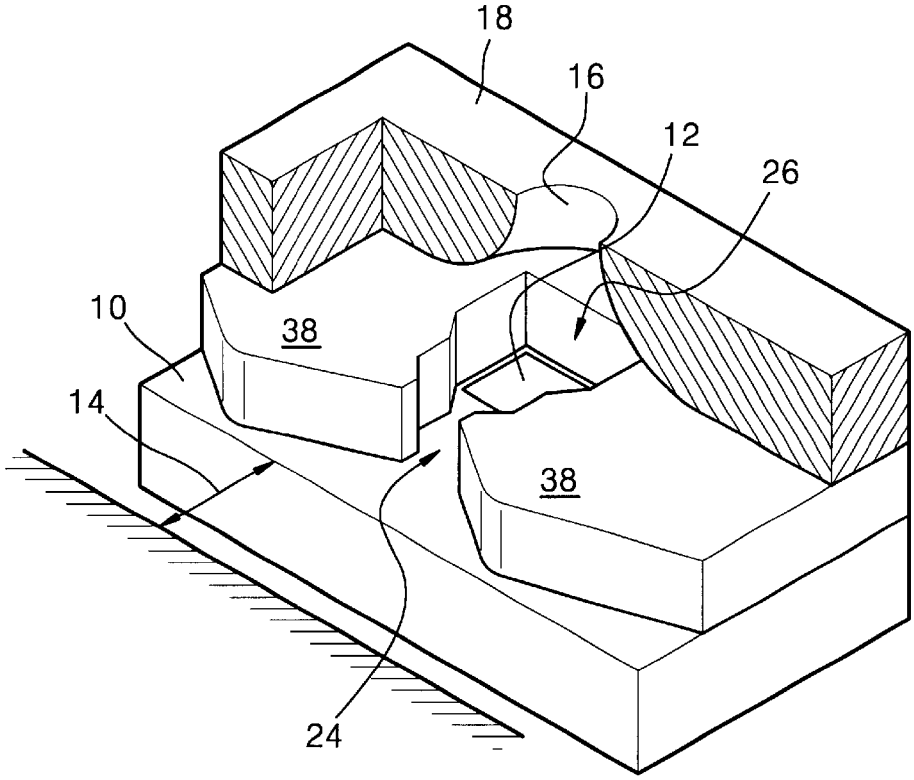
FIG. 1A (PRIOR ART)
FIG. 1A illustrates an exploded perspective view of an ink ejector of a conventional bubble jet type ink-jet printhead.
Figure 1B:
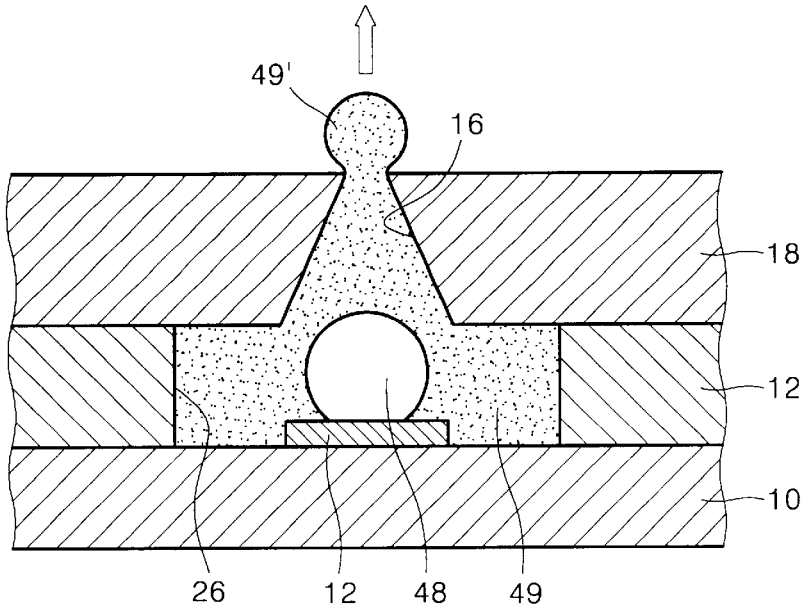
FIG. 1B (PRIOR ART)
FIG. 1B illustrates a cross-sectional view for explaining a process of ejecting an ink droplet from the ink-jet printhead of FIG. 1.
Figure 1C:
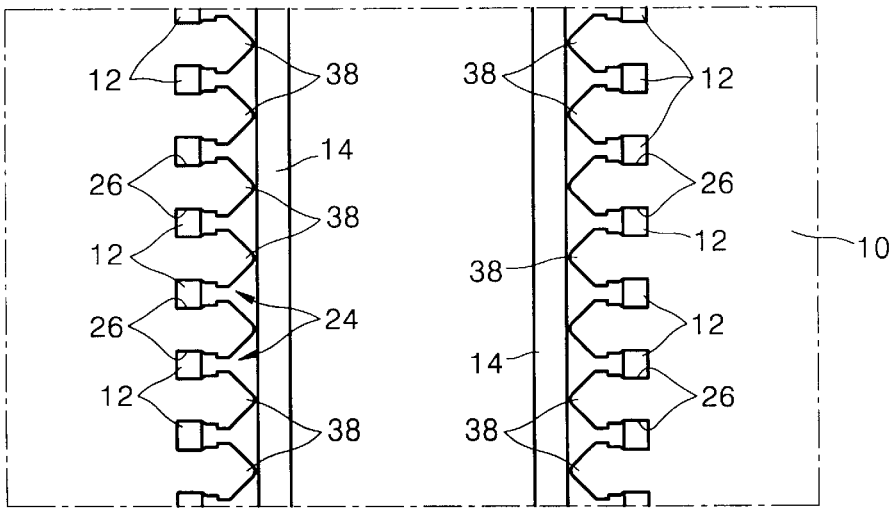
FIG. 1C (PRIOR ART)
FIG. 1C illustrates a plan view of the conventional ink-jet printhead of FIG. 1A showing an arrangement of a plurality of nozzles.

Korean Patent Application No. 2001-66747, filed Oct. 29, 2001, and entitled: "High-Density Ink-jet Printhead having Multi-Arrayed Structure," is incorporated by reference herein in its entirety.

Hereinafter, the present invention will be described in detail by describing a preferred embodiment of the present invention with reference to the accompanying drawings. Like reference numerals refer to like elements throughout the drawings. In the drawings, the shape and thickness of an element may be exaggerated for clarity and convenience. Further, it will be understood that when a layer is referred to as being on another layer or "on" a substrate, it may be directly on the other layer or on the substrate, or intervening layers may also be present.

Figure 2:
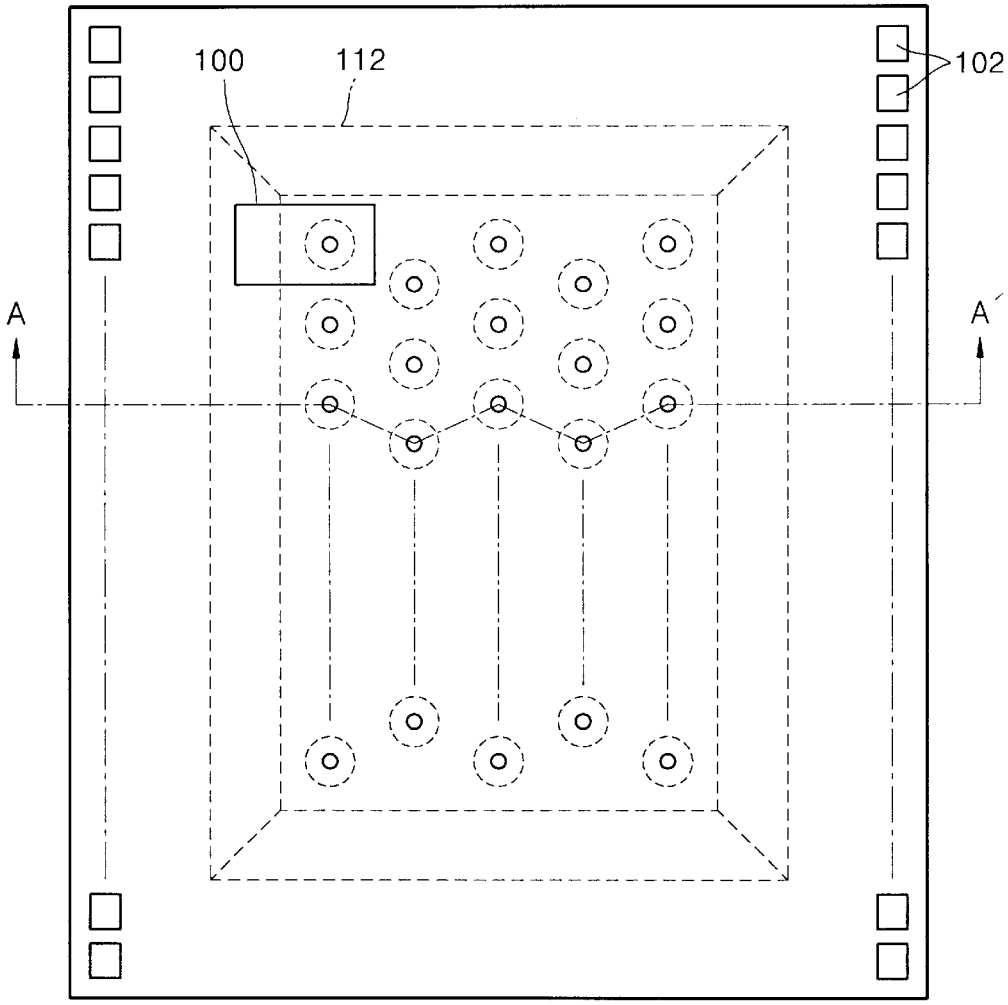
FIG. 2 illustrates a plan view of an ink-jet printhead according to a preferred embodiment of the present invention.
Figure 3:
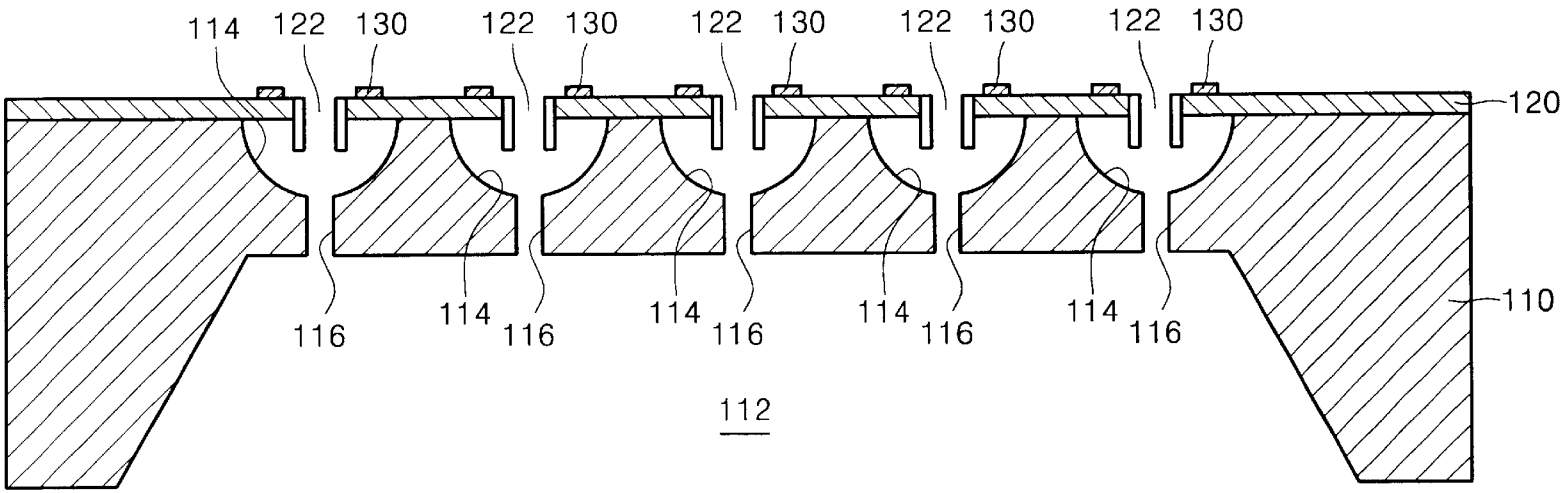
FIG. 3 illustrates a cross-sectional view of the ink-jet printhead of FIG. 2, taken along line A–A'.

FIG. 2 illustrates a plan view of an ink-jet printhead according to a preferred embodiment of the present invention. FIG. 3 illustrates a cross-sectional view of the ink-jet printhead of FIG. 2, taken along line A–A'.

Referring to FIGS. 2 and 3, in the ink-jet printhead according to a preferred embodiment of the present invention, five rows of ink ejectors 100 are arranged in a zigzag pattern on an ink supply manifold 112, which is illustrated by dotted lines. Bonding pads 102 that are connected to each ink ejector 100 and are to be bonded with wires are positioned at both sides of each ink ejector 100. Additionally, the manifold 112 is in flow communication with an ink storage unit (not shown) filled with ink.

The manifold 112 is formed at a rear surface of a substrate 110, and a nozzle plate 120 having a plurality of nozzles 122 is formed on an opposing surface of the substrate 110. Each one of a plurality of heaters 130 encircles a corresponding one of the plurality of nozzles 122, which are formed on the nozzle plate 120. Also, hemispherical ink chambers 114, each one corresponding to one of the plurality of nozzles 122, are formed on the substrate 110. A plurality of ink channels 116 are formed to pass through a bottom of each ink chamber 114, which are in flow communication with the manifold 112.

The plurality of nozzles 122 are arrayed to be positioned on one manifold 112 in at least three rows, and preferably in five rows, as shown in FIG. 3. Further, the plurality of nozzles 122 may be freely arranged according to a printing algorithm for realizing an image. Since the plurality of nozzles 122 have a two-dimensional multi-array structure, it is possible to increase the number of nozzles per unit area, thereby enhancing the speed of printing and realizing a high-density ink-jet printhead having high resolution.

Figure 4:
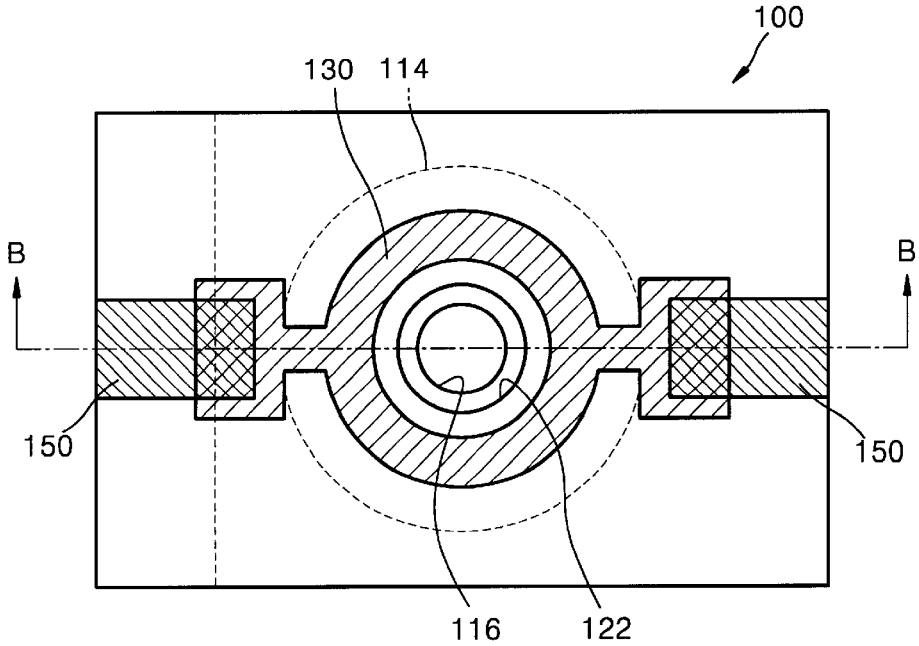
FIG. 4 illustrates a plan view of a unit ink ejector of the ink-jet printhead of FIG. 2.
Figure 5:
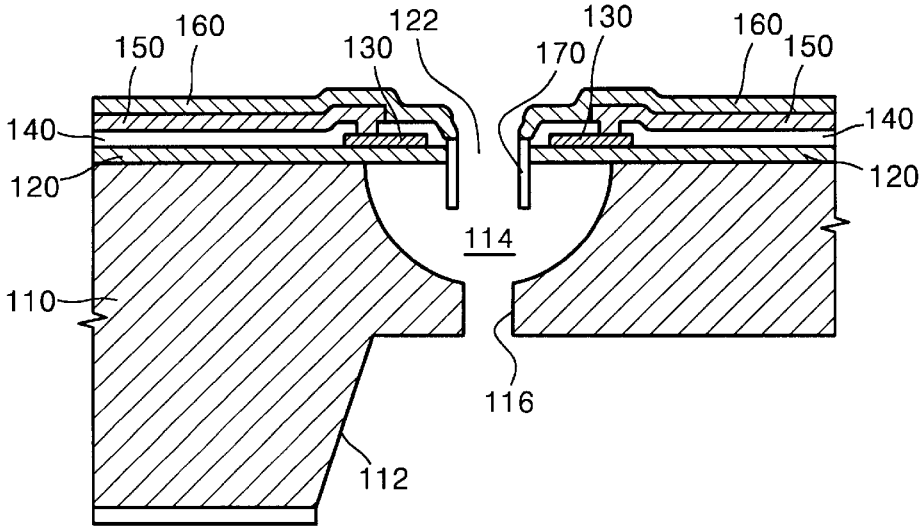
FIG. 5 illustrates a cross-sectional view of the unit ink ejector of FIG. 4, taken along line B–B'.

FIG. 4 illustrates a plan view of a unit ink ejector 100 of FIG. 2. FIG. 5 illustrates a cross-sectional view of the vertical structure of the unit ink ejector 100 of FIG. 4, taken along line B–B'. Referring to FIGS. 4 and 5, an ink chamber 114, which is filled with ink, is formed on a substrate 110 of the ink ejector 100, and a manifold 112, which supplies ink to the ink chamber 114, is formed at a rear surface of the substrate 110. In addition, a manifold 112 and an ink channel 116, which connects the ink chamber 114 and the manifold 112, are formed at a center of a bottom of the ink chamber 114. Preferably, the ink chamber 114 is hemispherical shaped.

Also preferably, the substrate 110 is formed of a silicon material that is used in fabricating an integrated circuit. For instance, the substrate 110 may be a silicon substrate of a crystal orientation of (100) and a thickness of about 500 $\mu$m. Use of a silicon wafer as the substrate 110 facilitates mass-production of the ink ejectors 100. The ink chamber 114 may be formed by isotropically etching the surface of the substrate 110 that is exposed via the plurality of nozzles 122, which are formed on a nozzle plate. Formation of the plurality of nozzles 122 will be explained later. The manifold 112 is formed by anisotropically etching the rear surface of the substrate 110 or by etching the rear surface of the substrate 110 to have a predetermined inclination. Here, the ink chamber 114 is formed in a hemispherical shape having a depth and a radius of about 20 $\mu$m. Alternatively, the ink chamber 114 may be formed by anisotropically etching the substrate 110 to a predetermined depth and then, isotropically etching the etched substrate 110. The ink channel 116 may be formed by anistropically etching a center of a bottom of the ink chamber 114 via the nozzle 122. The diameter of the ink channel 116 is the same as or slightly smaller than that of the nozzle 122, thereby preventing ejected ink from flowing back into the ink channel 116. The diameter of the ink channel 116 affects the speed of refilling ink after the ejecting of the ink, and thus must be precisely controlled.

At a surface of the substrate 110, a nozzle plate 120 having the plurality of nozzles 122 is formed to provide the upper walls of the ink chamber 114. When the substrate 110 is formed of silicon, the nozzle plate 120 may be a silicon oxide layer that is formed by oxidizing the silicon substrate 110. More particularly, a silicon wafer is wet or dry-oxidized in an oxidation furnace, thereby forming an oxide layer on the silicon substrate 110, and thus the nozzle plate 120.

On the nozzle plate 120, a heater 130 is formed to encircle each nozzle 122. The heaters 130 are used to generate bubbles in the ink. Preferably, these heaters 130 have a shape of a round-shaped ring and are formed of resistant heating elements, such as a polysilicon layer doped with impurities. Here, the impurity-doped polysilicon layer may be deposited to a predetermined thickness with a source gas such as phosphorous (P) as an impurity by a low-pressure chemical vapor deposition (LPCVD). The thickness of the polysilicon layer deposited is determined so as to have a proper resistance value in consideration of the width and length of the heater 130. The polysilicon layer, which is deposited on the entire surface of the nozzle plate 120, is patterned to a round ring shape by a photolithographical process using a photomask and photoresist and an etching process using a photoresist pattern as an etching mask.

On the nozzle plate 120 and the heater 130, a silicon nitride layer may be formed as a first passivation layer 140 that protects the heater 130. The first passivation layer 140 may also be deposited to a thickness of about 0.5 $\mu$m by a LPCVD.

Additionally, the heater 130 is connected to metal electrodes 150 so that a pulse current may be applied to the heater 130. Here, the electrodes 150 are connected to the diameter of the heater 130 to face each other. More specifically, a portion of the first passivation layer 140, which is formed of a silicon nitride layer, is etched to expose a portion of the heater 130 to which the electrode 150 is connected. Next, the electrode 150 is formed by depositing a metal material, which has excellent conductivity and is easily patterned, e.g., aluminum or an aluminum alloy, to a thickness of about 1 $\mu$m by a sputtering method and patterning the same. At the same time, the metal layer constituting the electrode 150 is patterned to form a wiring (not shown) and the bonding pad (120 of FIG. 2) on another portion of the substrate 110.

A silicon oxide layer is formed on the first passivation layer 140 and the electrode 150 as a second passivation layer 160. The second passivation layer 160 may be formed to a thickness of about 1 $\mu$m by a chemical vapor deposition at a low temperature, e.g., 400° C., within a range that the electrode 150 and the bonding pad 102 are not deformed.

After the second passivation layer 160 is formed, a photoresist pattern is formed on the resultant structure. Then, the first and second passivation layers 140 and 160 and the nozzle plate 120 are sequentially etched with the photoresist pattern as an etching mask to form the nozzle 122 having a diameter of between about 16–20 $\mu$m. Next, the ink chamber 114 and the ink channel 116 are formed via the nozzle 112, as described above.

The bottom of the ink chamber 114 conforms to a hemispherical shape, but may additionally include nozzle guides 170, which extend in the depth direction of the ink chamber 114 from the edges of the nozzle 122, at an upper portion thereof. The droplet of ink may be precisely ejected in the vertical direction of the substrate 110 via the nozzles 122 due to the nozzle guide 170. Such a nozzle guide 170 may be formed when the ink chamber 114 is made. That is, an exposed portion of the substrate 110 is anisotropically etched via the nozzle 122 to form a groove to a predetermined depth. Then, a predetermined layer, such as tetraethylortho silicate (TEOS) oxide layer, is deposited along the inner surface of the groove to a thickness of about 1 $\mu$m. Thereafter, the TEOS oxide layer formed at the bottom of the groove is etched and removed. As a result, the nozzle guide 170, which is formed of the TEOS oxide layer, is formed along the inner circumference of the groove. Next, a portion of the substrate 110 that is exposed through the bottom of the groove is isotropically etched to form the ink chamber 114 having the nozzles guides 170 at upper portions thereof.

Figure 6A:
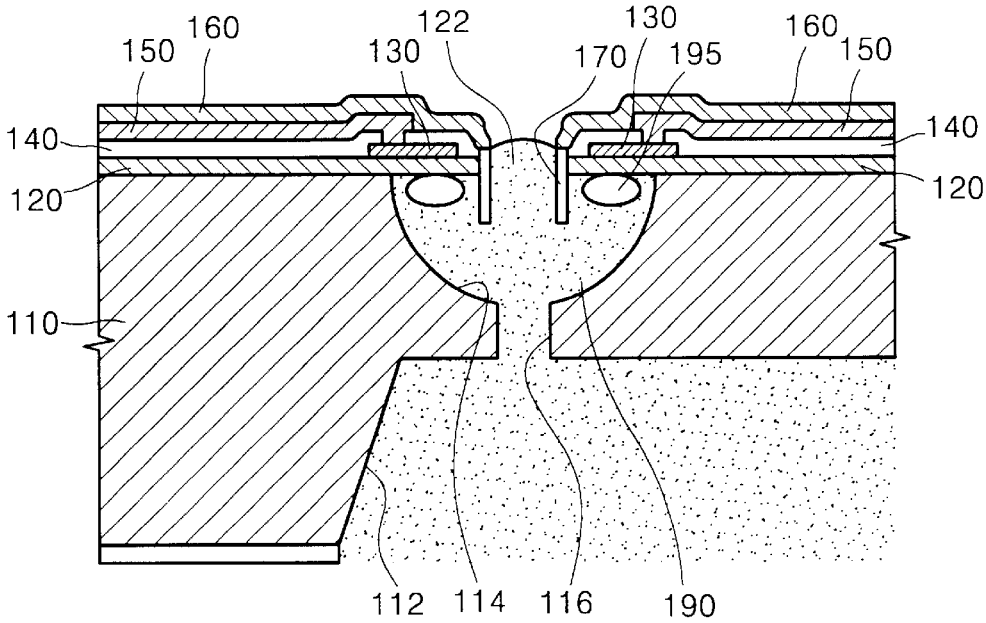
FIGS. 6A and 6B illustrate cross-sectional views of the mechanism of ejecting ink from an ink ejector having the structure shown in FIG. 5.
Figure 6B:
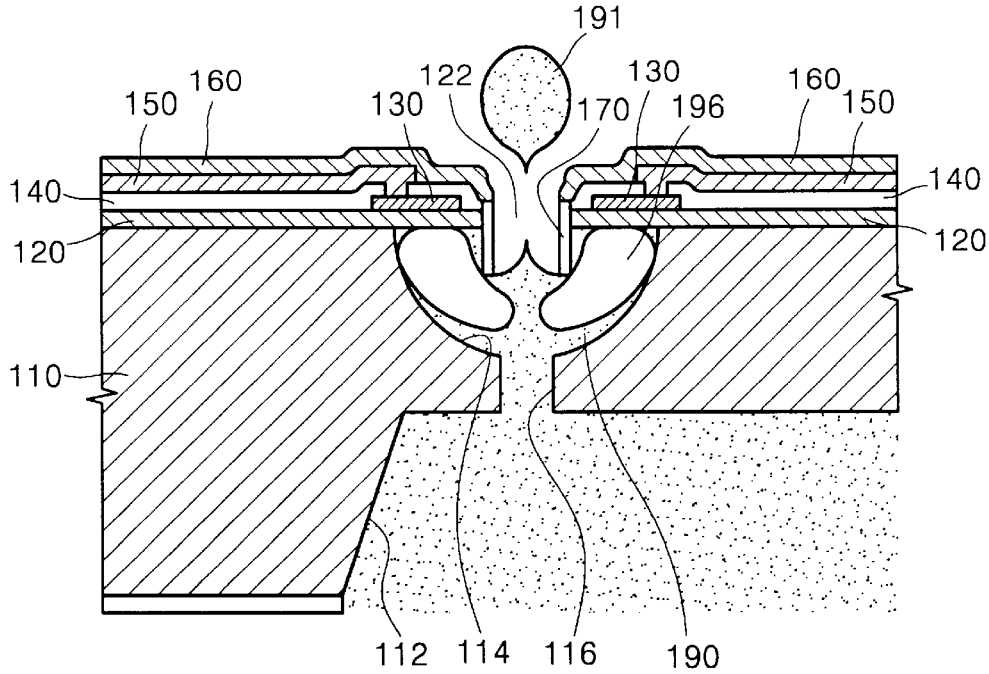

Hereinafter, a mechanism of ejecting an ink droplet from an ink-jet printhead according to the present invention will now be explained with reference to FIGS. 6A and 6B. Referring to FIG. 6A, ink 190 is supplied to an ink chamber 114 via a manifold 112 and an ink channel 116 due to capillary action. When the ink chamber 114 is filled with the ink 190, a pulse current is applied to the heater 130 through the electrode 150 to generate heat in the heater 130. The heat generated is transmitted to the ink 190 filled in the ink chamber 114 via a nozzle plate 120 below the heater 130. As a result, the ink 190 boils to generate a bubble 195 in the ink chamber 114. The shape of the bubble 195 varies depending on the shape of the heater 130, but conforms to a doughnut shape in most cases.

The bubble 195 of a doughnut shape expands as time elapses. As shown in FIG. 6B, an ink droplet 191 is ejected from the ink chamber 114 via the nozzle 122 due to the pressure of the expanded bubble 196. At this time, the ejection of the ink droplet 191 can be guided by the nozzle guide 170, and thus, it is possible to eject the ink droplet 191 precisely in the vertical direction of the substrate 110. Also, since the ink chamber 114 is formed as a hemisphere, it is possible to prevent backflow of ink, thereby reducing cross talk with adjacent ink ejectors. Furthermore, it is possible to more effectively prevent the back flow of the ink 190 in the case where the diameter of the ink channel 116 is smaller than that of the nozzle 122.

In addition, since the heater 130 has a round ring shape, the heaters have a large surface area. Accordingly, the heaters 130 may be easily heated and cooled, so that a period of time during which the bubble 195 is generated, expands, and collapses, is reduced. Thus, an ink-jet printhead according to the present invention has a high driving frequency and is capable of ejecting ink on paper rapidly. The ink chamber 114 has a hemispherical shaped and thus, the bubble 195 may be more stably generated and expanded as compared to ink chambers of conventional ink-jet printhead having a hexahedron or a pyramid-type shape. Further, the bubbles 195 and 196 can be generated and expanded quickly, which enables rapid ejection of ink.

After the ink droplet 191 is ejected from the ink chamber 114, the ink 190 is cooled and then, the expanded bubble 196 collapses or breaks when a current, which was applied to the heater 130, is blocked. Next, the ink chamber 114 is filled with the ink 190 again.

In conclusion, a high-density ink-jet printhead according to the present invention has the following advantageous. First, a plurality of nozzles are arranged on one ink supply manifold in a plurality of rows, and thus, the density of nozzles may be increased, thereby enhancing the printing speed and providing high resolution printing quality. Second, a substrate having ink chambers and ink channels, a nozzle plate, heaters and electrodes are united on a silicon substrate. Therefore, an ink-jet printhead according to the present invention is easy to manufacture, and further, problems due to misalignment of components may be reduced. Also, such an ink-jet printhead is capable of being mass-produced because a substrate thereof can be a silicon wafer such as are adopted in a process of manufacturing semiconductor devices. Third, in an ink-jet printhead according to the present invention, a heater is formed in a ring shape and an ink chamber is formed in a hemispherical shape. Accordingly, the expansion of bubbles is limited to within the ink chamber, thereby preventing any back flow of ink filled in the ink chamber. Thus, such an ink-jet printhead is free from cross talk resulting from adjacent ink ejectors. Moreover, the direction of ejection of an ink droplet may be guided by nozzle guides, thereby ejecting ink precisely in the vertical direction of a substrate.

A preferred embodiment of the present invention has been disclosed herein and, although specific terms are employed, they are used and are to be interpreted in a generic and descriptive sense only and not for purpose of limitation. For example, alternate materials may be used as materials for use in elements of the printhead according to the present invention. That is, the substrate may be formed of another material having a good processing property, as well as silicon, and the same applies to the heater, electrodes, the silicon oxide layer, and the silicon nitride layer. In addition, the described method for stacking and forming materials is only for explanatory reasons, and various deposition and etching methods may be used. Accordingly, it will be understood by those of ordinary skill in the art that various changes in form and details may be made without departing from the spirit and scope of the present invention as set forth in the following claims.

What is claimed is:

1. An ink-jet printhead, comprising:

a substrate;

a plurality of ink chambers formed in a hemispherical shape at a surface of the substrate and filled with ink;

a manifold formed at a rear surface of the substrate, the manifold for supplying ink to the plurality of ink chambers;

a plurality of ink channels each formed at a bottom of each of the plurality of ink chambers to be in flow communication with the manifold;

a nozzle plate monolithically formed with the substrate;

a plurality of nozzles formed on the nozzle plate, each formed to correspond to a center of each of the plurality of ink chambers and each including a nozzle guide extending in a depth direction of the ink chamber at each edge of the plurality of nozzles;

a plurality of heaters formed on the nozzle plate, each of the plurality of heaters having a ring shape and encircling a corresponding one of the plurality of nozzles; and a plurality of electrodes positioned on the nozzle plate and electrically connected to the plurality of heaters, the plurality of electrodes applying current to the heaters, wherein the plurality of nozzles are arrayed on the manifold in at least three rows.

2. The ink-jet printhead as claimed in claim 1, wherein the plurality of nozzles are arrayed in five rows.

3. The ink-jet printhead as claimed in claim 1, wherein the substrate is a silicon wafer.

4. The ink-jet printhead as claimed in claim 3, wherein the nozzle plate is a silicon oxide layer formed by oxidizing a surface of the silicon wafer.

5. The ink-jet printhead as claimed in claim 1, wherein the rows of the plurality of nozzles arrayed on the manifold are arranged in a zigzag pattern.

6. An ink-jet printhead, comprising:

a substrate;

a plurality of ink chambers formed in a hemispherical shape at a surface of the substrate and filled with ink;

a manifold formed at a rear surface of the substrate, the manifold for supplying ink to the plurality of ink chambers;

a plurality of ink channels each formed at a bottom of each of the plurality of ink chambers to be in flow communication with the manifold;

a nozzle plate monolithically formed with the substrate;

a plurality of nozzles formed on the nozzle plate, each formed to correspond to a center of each of the plurality of ink chambers;

a plurality of heaters formed on the nozzle plate, each of the plurality of heaters having a ring shape and encircling a corresponding one of the plurality of nozzles;

a first passivation layer formed on the nozzle plate and the plurality of heaters for protecting the plurality of heaters, wherein the first passivation layer is deposited to a thickness of about 0.5 $\mu$m by a low-pressure chemical vapor deposition (LPCVD); and a plurality of electrodes positioned on the nozzle plate and electrically connected to the plurality of heaters, the plurality of electrodes applying current to the heaters, wherein the plurality of nozzles are arrayed on the manifold in at least three rows.

7. The ink-jet printhead as claimed in claim 6, wherein the first passivation layer is a silicon nitride layer.

8. The ink-jet printhead as claimed in claim 6, further comprising a second passivation layer formed on the first passivation layer and the plurality of electrodes.

9. The ink-jet printhead as claimed in claim 8, wherein the second passivation layer is a silicon oxide layer.

10. An ink-jet printhead, comprising:

a substrate;

a plurality of ink chambers formed in a hemispherical shape at a surface of the substrate and filled with ink;

a manifold formed at a rear surface of the substrate, the manifold for supplying ink to the plurality of ink chambers;

a plurality of ink channels each formed at a bottom of each of the plurality of ink chambers to be in flow communication with the manifold;

a nozzle plate monolithically formed with the substrate;

a plurality of nozzles formed on the nozzle plate, each formed to correspond to a center of each of the plurality of ink chambers;

a plurality of heaters formed on the nozzle plate, each of the plurality of heaters having a ring shape and encircling a corresponding one of the plurality of nozzles;

a first passivation layer formed on the nozzle plate and the plurality of heaters for protecting the plurality of heaters;

a plurality of electrodes positioned on the nozzle plate and electrically connected to the plurality of heaters, the plurality of electrodes applying current to the heaters; and a second passivation layer formed on the first passivation layer and the plurality of electrodes, wherein the second passivation layer is formed to a thickness of about 1 $\mu$m by a chemical vapor deposition at a temperature of about 400° C., wherein the plurality of nozzles are arrayed on the manifold in at least three rows.

* * * * *